United States Patent [19]

Korr et al.

[11] 4,109,883

[45] Aug. 29, 1978

[54] ANTI-MISSILE MISSILE

[75] Inventors: Abraham L. Korr; David B. Rosenblatt, both of Philadelphia, Pa.

[73] Assignee: The United States of America as represented by the Secretary of the Army, Washington, D.C.

[21] Appl. No.: 444,515

[22] Filed: Mar. 29, 1965

[51] Int. Cl.[2] ..... F41G 9/00

[52] U.S. Cl. ..... 244/3.1; 244/158

[58] Field of Search ..... 244/15.5, 14, 3.1, 3.11, 244/158, 164; 328/233, 256

[56] References Cited

U.S. PATENT DOCUMENTS

| | | | |
|---|---|---|---|
| 2,783,684 | 3/1957 | Yoler | 89/8 X |
| 3,036,213 | 5/1962 | Dessler et al. | 250/49.5 X |
| 3,086,424 | 4/1963 | Lio | 89/8 |
| 3,131,300 | 4/1964 | Jeter et al. | 328/233 X |
| 3,153,367 | 10/1964 | Ross et al. | 89/1 |
| 3,239,712 | 3/1966 | Norris | 328/233 X |

OTHER PUBLICATIONS

"Anti-Satellite Techniques Investigated", Aviation Week, 10/3/60, pp. 54, 55, 57, 59, 63.

*Primary Examiner*—Malcolm F. Hubler
*Attorney, Agent, or Firm*—Nathan Edelberg; Harold H. Card, Jr.; A. Victor Erkkila

[57] ABSTRACT

An anti-missile missile employing an accelerator of the Van de Graaff or linear type which is carried by the missile to propel particles, such as gamma aluminum oxide, at hypervelocities, the particles being as small as about $10^{-7}$ cm in diameter.

3 Claims, 1 Drawing Figure

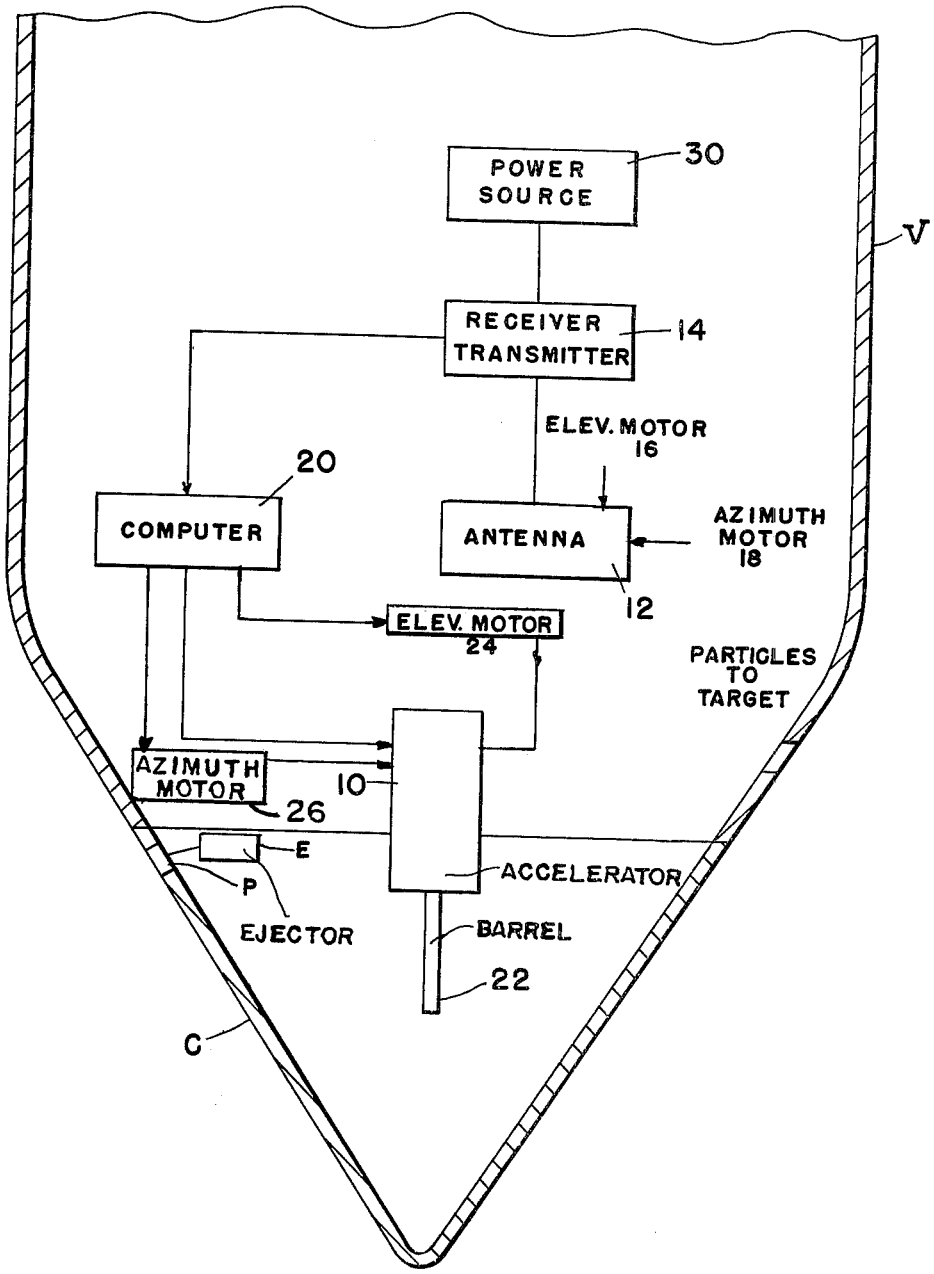
POWER SOURCE
30
V
RECEIVER TRANSMITTER
14
ELEV. MOTOR 16
20
COMPUTER
ANTENNA
AZIMUTH MOTOR 18
12
ELEV. MOTOR 24
PARTICLES TO TARGET
AZIMUTH MOTOR
10
26
E
P
ACCELERATOR
EJECTOR
BARREL
22
C

ANTI-MISSILE MISSILE

The invention described herein may be manufactured and used by or for the Government for governmental purposes without the payment to us of any royalty thereon.

This invention relates to anti-missile missiles and more particularly concerns such devices which will defeat enemy missiles flying at any anticipated speeds and at altitudes in excess of about 100 miles.

The present invention has been designed specifically as an effective weapons system for use particularly in regions above the appreciable atmosphere, or at altitudes of about 100 miles or more where aerodynamic control is generally negligible. In the following description, our device will be discussed primarily as a defensive system designed to intercept and destroy oncoming intercontinental ballistic missiles (ICBM) and satellites which will be referred to herein as targets.

The intercontinental ballistic missile carrying a nuclear warhead is concededly the potentially most dangerous implement of warfare available in any presently known weapons system complex. With a range in excess of 5000 miles and a velocity of more than 10,000 miles per hour, the ICBM is capable of delivering its destructive payload from a distant launching site in a matter of minutes. It was early recognized that a primary problem in anti-ICBM defense resides in lack of a reasonable warning time. Without adequate advance notice, the problem of interception practically defies solution. Recognition of the need for early warning resulted in the development of long range radar systems, high speed digital computers and associated components capable of detecting, locating, and evaluating an ICBM threat while the "enemy" missile still is perhaps several thousand miles from its intended target, thus allowing a defense command from 5 to 10 minutes to meet and destroy the missile well away from the target area.

The anti-missile program has followed a logical development based on the concept of launching a high altitude, high speed missile designed to intercept the impending threat at some distant point in its trajectory where destruction of the ICBM will result. However, it has been established that such long range, high altitude interceptions necessitate requirements which exceed the capabilities of existing ground based guidance systems. In other words, given the benefit of all necessary data regarding the "enemy" ICBM, ground control cannot consistently or even generally come within a 10° initial range error in launching a defensive missile weapon.

Midcourse and terminal controls have thus been utilized in an effort to correct for initial error. Midcourse control, actuated either from the ground or from missile borne instruments, has been found to be unable to correct the defensive missile path to within effective distance of the planned intercept point.

Thus, the burden has temporarily fallen on terminal control guidance of the defensive weapon to effectuate a hit. To date, terminal guidance has consisted solely of side-thrust maneuvering, which may be generally summarized as follows:

Extremely high closing velocities between the enemy target missile and the defensive weapon limit available control time to a matter of seconds even with reasonably long range missile borne seekers or fire control systems, resulting in demands for unattainably high "*g*" load maneuvers even for small initial errors against non-maneuvering targets. Extremely high target speeds make impractical the design of a defensive interceptor weapon with a speed advantage. This severely restricts permissible flight geometry at the inception of terminal guidance. The lack of an aerodynamic medium to provide support for the control surfaces on the defensive weapon shifts the burden of control to reaction thrusting devices, resulting in need for complex rocket chamber geometry and serious fuel weight penalties.

As an example of the foregoing problems: Assume an "enemy" ICBM in free flight approaching at 16,000 feet per second; assume a defensive missile launched with only a 10° initial error in the direction of interceptor weapon velocity, which may be about 4000 feet per second; and assume further a target tracing device operative along a line of sight having a range of 80,000 feet. Although the assumed figures are favorable to the intercepting weapon missile, an error of approximately 3000 feet will develop and must be overcome by terminal control within 4 seconds if a hit is to be stored, thus making necessary a 10 "*g*" side thrust applied without delay.

It is apparent that the possibility of achieving a hit under the assumed favorable conditions is practically non-existent. Further, it is obvious that if the target were a satellite with a minimum velocity on the order of 26,000 feet per second, the above problems would be of significantly greater magnitude.

To avoid necessity for a close intercept by our intercepting or orbiting vehicle, we would provide our anti-missile missile with an accelerator or gun which directs small particles at the oncoming missile at hypervelocities having a dispersion solid angle, covering the volume of a cone with vortex at the gun.

There is some knowledge concerning the impact effect on targets when struck by small particles travelling at hypervelocities.

Micrometeoroids are distributed throughout space, their abundance being approximately $10^4$ times greater near Earth in comparison to those detected by Mariner II in its interplanetary trajectory. The population distribution of the micrometeoroids is inversely proportional to size.

Velocities of micrometeoroids orbiting the earth have been recorded at 11 to 72 km/sec with an average of 30 km/sec.

For long-life satellites such as the Telstar, Relay, and the Syncom series, relatively high flux micrometeoroids trapped in the Earth's field present a serious environmental hazard whose effects include erosion, surface cratering, and surface skin puncture. This same effect will cause defeat of an ICBM if the flux, velocity and mass of the particles are optimized.

Simulation of micrometeoroids has been achieved by various groups in laboratories. Electrostatic acceleration of micron-sized particles is the method used in achieving micrometeoroid velocities. Such high velocities have been achieved by use of a particle charging and injection system coupled to Van de Graaff accelerators by investigators studying micrometeorites.

Some investigators utilizing contact charging techniques, have consistently succeeded in positively charging one-micron diameter carbonyl iron spheres to surface field strengths of about $2.5 \times 10^9$ volts/meter approximately 10% of theoretical. Values to $3.5 \times 10^9$ volts/meter have been achieved. With a two million volt accelerator, particle velocities in the 5 – 6 km/sec range have been achieved. Smaller particles have been accelerated to 10 km/sec. Use of a four million volt accelerator will increase the expected velocity, for the one-micron diameter particles, to 7.5 - 9 km/sec. With improvements in particle charging techniques, the velocity should be increased further. Furthermore, it has been proposed that the lower energy accelerators be used as injectors into linear accelerators, the eventual aim being to duplicate full range of velocities found in the micrometeoroid environment.

The final velocity $v$ in meters/sec of a particle of mass $m$ in kg, carrying a charge of $q$ coul. and accelerated through a potential difference V is:

$$v = (2Vq/m)^{1/2} \text{ meters/sec}$$

Thus, the ultimate velocity is proportional to $V^{1/2}$ and $(q/m)^{1/2}$ where $q/m$ is the charge-mass ratio. For a smooth sphere of radius $r$, density $\rho$ and of surface electric field $E_s$:

$$q/m = 3\,\epsilon_o E_s/\rho\, r \text{ coul./kg}$$

where $\epsilon_o$ is the permittivity of free space. $E_s$, maximum, is limited by electron field emission for negatively charged spheres and by ion evaporation for positively charged spheres. The respective maximums are about $10^{10}$ volts/meter, positive, and $10^9$ volts/meter, negative.

Since these equations show that attainable velocity increases as the particle diameter decreases, it can be assumed that particles as small as $10^{-6}$ cm to $10^{-7}$ cm in diameter may be accelerated to velocities in excess of 100 miles/second. This fact, combined with other features described elsewhere in this invention, makes this system most effective as a means for defeating ICBMs. At this velocity, a stream of particles shot from our system may overtake and defeat by striking any point of enemy targets. The kinetic energy of the particles released upon impact with the target will cause physical and chemical changes of a mortal nature.

Further, with the advent of space exploration, it is becoming of vital importance to be able to determine the properties of various types of materials in a space environment. One of the characteristics of a space environment is the presence of minute particles traveling at tremendous velocities. These particles impact on the exterior of any vehicle traveling through space and have been found to cause erosion of the vehicle surfaces.

Since a knowledge of the effect of these particles is of considerable importance in the design of space vehicles for their protection, conversely, it would be most advantageous to use this knowledge as a means for destroying ICBM's and space vehicles.

It is therefore an object of this invention to provide novel means of near-sure defense against enemy ICBMs and satellite weapons.

It is another object of the invention to provide means of defeating enemy targets moving at any speeds at altitudes exceeding about 100 miles.

A further object of the invention is to defeat enemy targets moving at speeds even in excess of 17,000 miles per hour at altitudes exceeding about 100 miles by bombarding such targets with particles having a velocity in the range from $10^4$ to $3 \times 10^5$ miles per hour depending on the particle size.

Other objects and advantages will become more fully apparent from the claims, and from the following description when taken in conjunction with the annexed drawing in which the single FIGURE illustrates a simple block diagram of our anti-missile missile system in accordance with our invention.

Other means have been proposed in the past for the defeat of ICBMs. One such scheme is the use of plasma or ions which have accelerating means. However, plasma accelerating systems and ion accelerators are not generally effective in defeating enemy systems since plasmas or ions are not sufficiently damaging to likely enemy targets.

Our invention comprises shooting particles, from an accelerator at velocities up to the 100 km/sec range, being from about 10−2 to 10−7 cm in diameter, insuring a high degree of success against enemy missiles.

In a typical embodiment of our invention, small liquid or solid particles, e.g., gamma aluminum oxide, having a size of between about $10^{-2}$ to $10^{-7}$ cm in diameter are placed in an accelerator 10, which may suitably be of the Van de Graaff or linear accelerator type. If the Van de Graaff type is used it could be operated at a few million volts.

Referring again to the drawing, antenna 12 and transmitter-receiver 14 are so arranged in an orbiting or intercepting vehicle V to pick up the target when line of sight is established. Nose cone C is removed from vehicle V when the orbiting or intercepting vehicle has exceeded about 100 miles in altitude. The tracking system, controlled by the servos 16 and 18, picks up the oncoming target missile or satellite and transmits data to the computer 20 which may be of a conventional type that evaluates stored data and the data newly supplied by the receiver part of transmitter-receiver 14 and provides a signal which is determinate of the angular displacement for the accelerator 10 to project its barrel 22 in a direction to assure collision of particles with the enemy vehicle. Computer 20 directs the gun servo motors 24 and 26 which aim the barrel 22 and automatically fires the particles at the target, once aligned, by means well known in the art. Primary power for the tracking system, computer and gun servo motors is supplied by a power source 30.

Our carrier system upon attaining altitudes above the earth's surface approaching about 100 miles will have nose C ejected by ejection means E well known in the art, the ejection means being initiated or actuated by a typical pressure sensing transducing device, P, also well known in the art. This ejection of nose C becomes necessary in order that the accelerated particles shall not be impeded by the nose and its removal does not occur until the carrier system has reached a near vacuum environment which is required for the effective operation of the system. It should be understood that a turret comprising a multiplicity of guns may be part of our system. Said turrets can be part of our system regardless of whether our intercepting carrier system is ground launched or part of an orbiting satellite system.

Our invention does not wholly reside in the well-known circuitry antenna system servos and auxiliary elements but in the propelling of charged particles from an orbiting or intercepting vehicle, the particles having a critical size of $10^{-2}$ to $10^{-7}$ cm in diameter.

In the practice of our invention, let us assume our inventive apparatus is positioned within an orbiting or intercepting vehicle at 100 or more miles above the surface of the earth and an enemy target is picked up at some distant point by known instrumentation contained within the vehicle. The accelerator barrel having been computer aligned by means of their servos cause the charged particles to be "shot" at the enemy target. In traversing the distance to target the charged particles will have dropped due to gravitational forces. This will have been already compensated for by well known computer techniques including the target's velocity and trajectory.

Our device is not intended to be limited to the aforementioned heights and distances. At somewhat lower altitudes the emitted particles will encounter a greater number of atmospheric molecules but it is not anticipated that our device will be rendered ineffective thereby. Of course, preferred altitudes will be in excess of about 100 miles.

Since $q/m$ varies as $1/r$, if $r$ becomes greater, $(q/m)$ becomes smaller and the velocity goes down. Therefore, particles cannot be larger than about $10^{-2}$ cm or below $10^{-7}$ cm. Above $10^{-2}$ cm the particles become too large for acceleration to the required hypervelocity. Below $10^{-7}$ cm in the smaller range of particles, we come to particles of atomic dimensions. Such particles lose energy during their traverse (penetration) of targets by means of ionization effects or by atomic collisions. Damage by such particles would occur, but would be far less damaging than for the particles we are considering.

It is apparent from the foregoing description that we have provided an anti-missile missile, which, while in orbit or intercept trajectory is capable of defeating enemy targets approaching or retreating at any anticipated speeds and preferably in excess of 100 miles above the earth's surface by means of beams of particles of a critical diameter ranging between about $10^{-2}$ to $10^{-7}$ cm.

We claim:

1. In a carrier system traveling at altitudes of about 100 miles above the surface of the earth, an orbiting missile having a charge of fine particles therein for destroying an enemy target moving in a trajectory outside the earth's atmosphere, an apparatus for directing said charge into a collision course with said target; comprising:

a nose portion on said carrier system, means for ejecting said nose at certain altitudes, means for electrically charging particles prior to acceleration, said particles consisting essentially of gamma aluminum oxide having a size ranging between about $10^{-2}$ to $10^{-7}$ cm in diameter, an accelerator within said carrier system for propelling said particles therefrom at hypervelocities, means for detecting said target above the earth's atmosphere, and means for compensatingly directing said accelerator to propel said particles at said moving target.

2. The device of claim 1 wherein said accelerator is a Van de Graaff accelerator.

3. The device of claim 1 wherein said accelerator is a linear accelerator.

* * * * *